United States Patent [19]

Barr, Jr.

[11] 4,143,702

[45] Mar. 13, 1979

[54] REVERSE FLOW HEAT EXCHANGERS

[75] Inventor: James W. Barr, Jr., Rothschild, Wis.

[73] Assignee: Sterling Drug, Inc., NY, N.Y.

[21] Appl. No.: 808,976

[22] Filed: Jun. 22, 1977

Related U.S. Application Data

[63] Continuation-in-part of Ser. No. 608,242, Aug. 27, 1975, abandoned.

[51] Int. Cl.[2] ..... F28G 9/00

[52] U.S. Cl. ..... 165/1; 134/22 C; 134/30; 165/95; 165/97; 422/198

[58] Field of Search ..... 165/1, 95, 97; 134/22 C, 30; 23/260

[56] References Cited

U.S. PATENT DOCUMENTS

| | | | |
|---|---|---|---|
| 1,006,197 | 10/1911 | Frasch | 159/23 |
| 3,211,217 | 10/1965 | McKee et al. | 165/95 |
| 3,647,687 | 3/1972 | Matthiesen | 165/95 X |
| 3,948,679 | 4/1976 | Lewis | 134/22 C X |
| 4,033,407 | 7/1977 | Quintilliano | 165/95 |

*Primary Examiner*—Charles J. Myhre
*Assistant Examiner*—Margaret LaTulip
*Attorney, Agent, or Firm*—Charles R. Fay

[57] ABSTRACT

A heat exchanger wherein the hot and cold sides are arranged in side-by-side relationship, both sides being connected to a reactor by properly valved pipes, and means providing for a forward flow with reactor influent flowing through one side to the reactor and thermally conditioned liquid exiting from the reactor through the other side. Valves are selectively operable to reverse this flow.

One form of the invention utilizes a pair of heat exchangers utilizing a third heat transfer medium.

3 Claims, 3 Drawing Figures

REVERSE FLOW HEAT EXCHANGERS

This is a continuation-in-part of Ser. No. 608,242, filed Aug. 27, 1975, now abandoned.

BACKGROUND OF THE INVENTION

Scale is encountered in heat exchangers used in the conditioning of sludges. As incoming sludge is heated, scale is formed because of inverse solubilities of scale forming substances. These scales are limited in unconditioned sludge because of the low concentrations or absence of appreciable sulphate, oxalate and phosphate ions. After the thermal conditioning, these materials are present in quantities above their relative solubility, so that increased scaling occurs after the reactor. These scales are considered insoluble but as a matter of fact do have a small solubility, and by reversing the flow, the unconditioned or cooler sludge passing over the scale will dissolve some of it. It is the object of the present invention to remove the scale while reducing the down time needed to clean and maintain the heat exchangers, and to improve the efficiency and performance of thermal conditioning without the use of chemicals.

SUMMARY OF THE INVENTION

A heat exchanger comprises e.g. an inner small tube and an outer surrounding shell in tube form. This is sometimes referred to as a double-pipe or tube-in-tube heat exchanger. Other types suitable to the present invention include those with side-by-side construction.

Liquids may flow in either direction in the tube in the double-pipe heat exchanger and a different liquid may flow in the opposite direction in the shell, the liquid in the shell surrounding the tube. Both the tube and shell are connected to a reactor and proper valving is provided so that influent will pass selectively through either tube or shell to the reactor and thermally conditioned liquid from the reactor back through the heat exchanger in the opposite part thereof, whatever the particular type of heat exchanger is utilized. This apparatus thus provides for reverse flow of sludge and heated liquid merely dependent on opening and closing certain valving.

After a predetermined time of normal operation, which may be a day, week, or month, or when a certain pressure drop is observed, the flow is reversed as to both sludge and heated liquid, and this causes the scale removal and increased efficiency while continuing the operation, without the use of chemicals.

While the invention illustrates application to sludges, similar application of this principle will be obvious to those skilled in the art, e.g. in the treating in a heat exchanger of any liquid having a propensity to form scale because of inverse solubility.

PREFERRED EMBODIMENT OF THE INVENTION

In the disclosure herein "influent" refers to influent to the reactor bottom or intake, and "effluent" to effluent from the reactor top or outlet.

Figure 1:
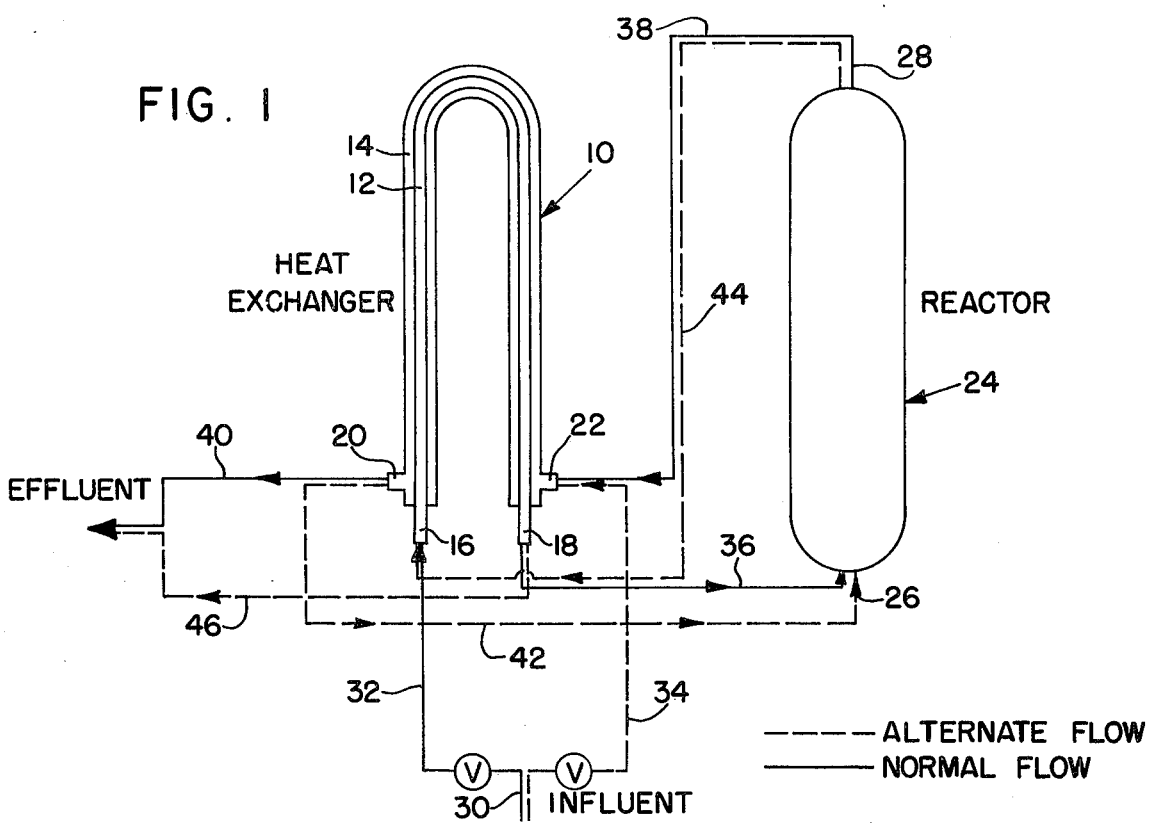
FIG. 1 is a diagram illustrating the basic apparatus.

The invention is illustrated as applied to the double-pipe heat exchanger, but the principle is the same in other types also. In FIG. 1 a double-pipe heat exchanger 10 is shown and this comprises the tube 12 and surrounding shell 14. The tube has openings at its ends at 16 and 18 and the shell has openings at 20 and 22. The reactor is indicated at 24 with bottom entrance 26 and top exit 28. The influent enters through a pipe at 30 and can be directed selectively to tube entrance 16 or shell entrance 22 through valved pipes 32 or 34.

If the influent enters the tube 12 at 16, it exits at 18 and is directed through a valved pipe 36 into the reactor at 26, and thermally conditioned liquid or effluent exiting from the reactor at 28 and proceeding through valved pipe 38 to the shell entrance at 22, through the shell, and exits at 20 through valved pipe 40. This has been shown in solid lines.

By proper manipulation of the valved pipes, a reactor influent and effluent are interchanged in the tube and shell of the heat exchanger with flow direction in the tube and shell prior to interchange maintained. In this case the reactor influent enters the shell at 22 and exits at 20. The influent exiting from the shell flows through pipe 42 and enters the bottom of the reactor at 26. The exiting conditioned effluent leaves the reactor at 28 and enters the tube through pipe 44 at 16, passing through the tube and exiting the system through pipe 46 from 18. This has been shown in dashed lines.

This operation assumes all appropriate valving and piping to switch the flows as described.

Figure 2:
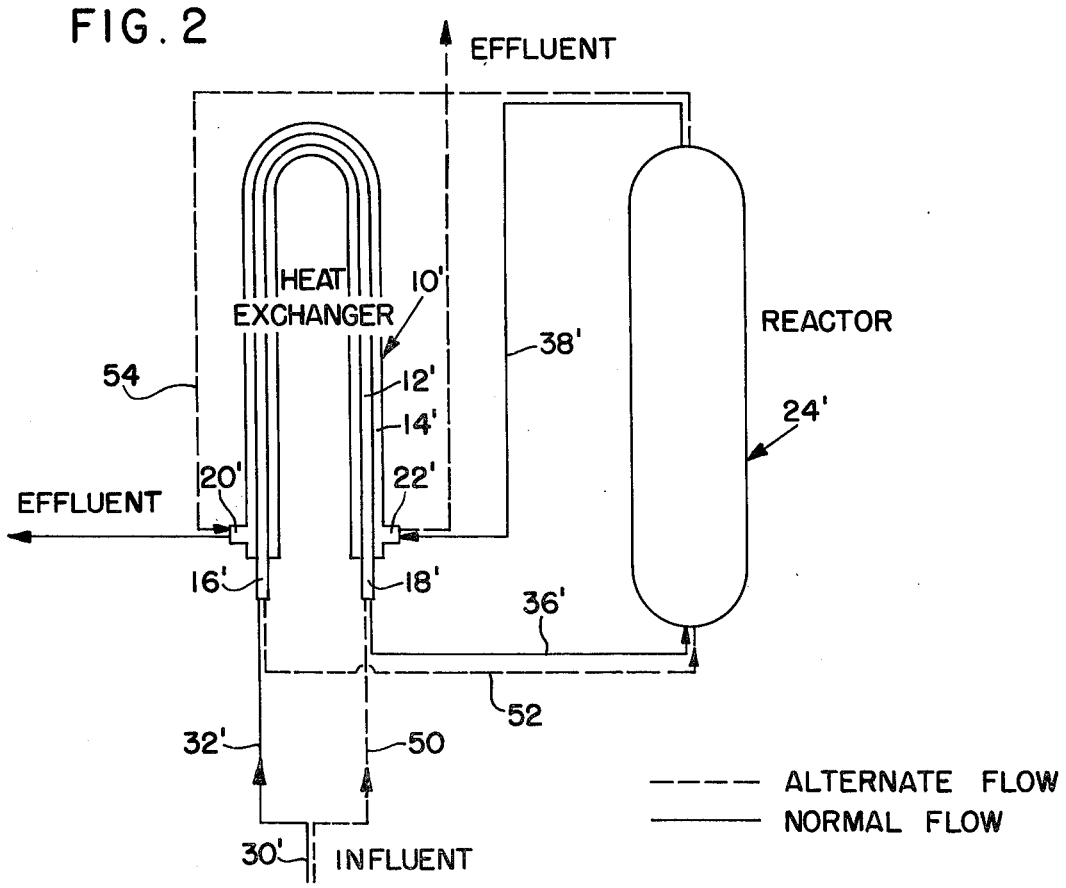
FIG. 2 is a like diagram showing a slightly different apparatus.

Referring now to FIG. 2, a modification is shown. The numerals in FIG. 2 are those of FIG. 1 primed where the parts are the same. The heat exchanger 10' and reactor 24' are as before described, the heat exchanger having the tube 12' and surrounding shell 14', with respectively entrances and exits at 16', 18' and 20' and 22'. The influent at 30' reverses flow in the tube, i.e. the entrance (32') to the tube becomes the exit (52) to the reactor, and the exit (36') to the reactor becomes the entrance (50) to the tube.

A reversal occurs as to the flow of conditioned liquid in the shell 14', see pipes 38' and 54. It will be seen that the influent does not enter the shell at any time and the liquid from the reactor does not flow through the tube. The effluent exits only from the shell, at 20' or 22' selectively.

Unlike FIG. 1, the reactor influent remains in the tube—no interchange—but its direction of flow is reversed; the reactor effluent remains in the shell; its flow is also reversed and the heat exchanger is operated in the countercurrent mode. The process of descaling embodied in FIG. 1 exploits an enhanced solubility due to both scale inverse solubility and the reduced concentration of the scale-forming ingredients of the influent, whereas the process of FIG. 2, which also reverses the large end-to-end temperature gradient, descales by inverse solubility only.

Figure 3:
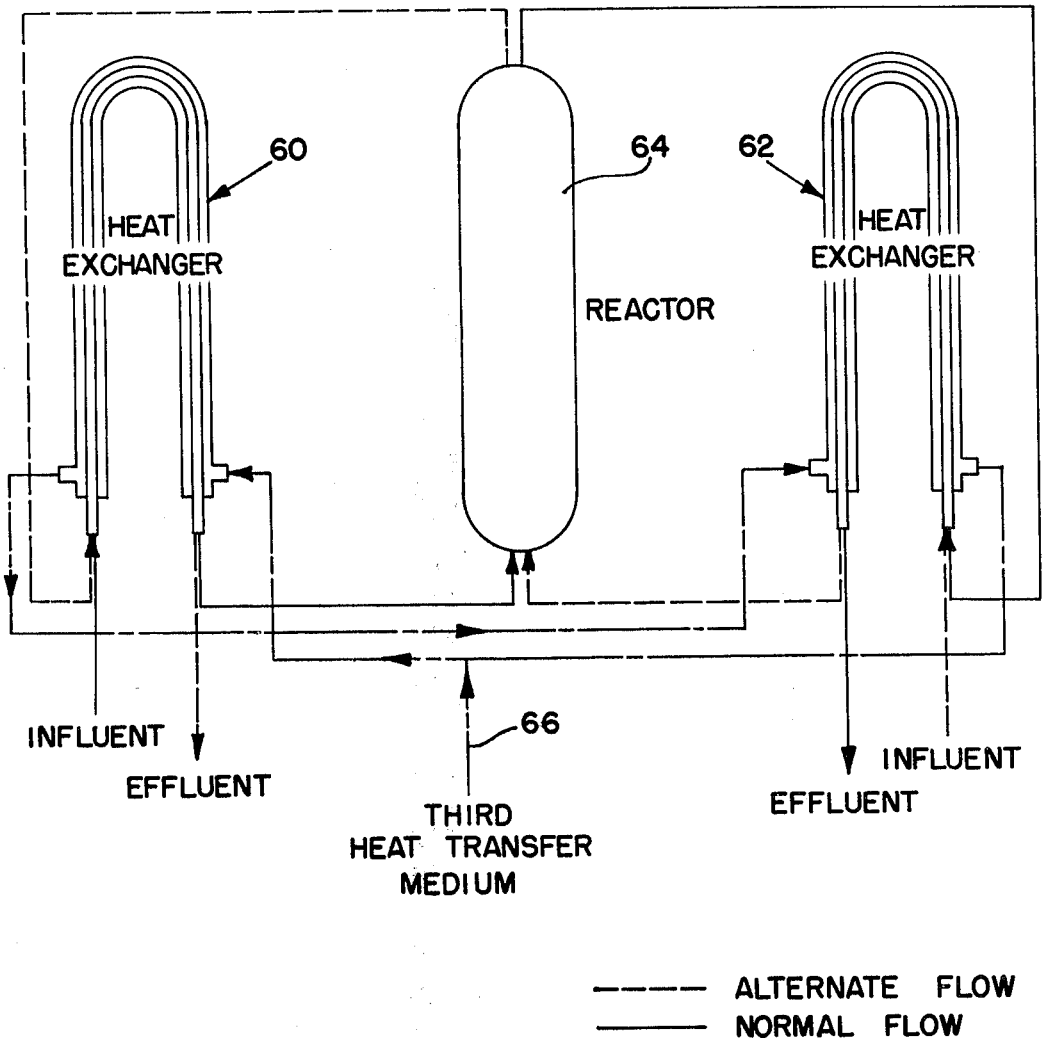
FIG. 3 is a diagram showing a modification.

The diagram of FIG. 3 utilizes different numerals from those of FIGS. 1 and 2 because the apparatus of FIG. 3 utilizes a third recirculating heat transfer medium, necessitating another heat exchanger. The third recirculating heat transfer medium may be water or any other suitable medium that flows in the shells of the heat exchangers 60 and 62, the reactor being indicated at 64. These apparatuses are similar to those above described as to FIGS. 1 and 2, but of course, the piping is different. As indicated, the reactor influent flows into one entrance of either tube selectively, passes into the reactor, and the conditioned liquid flows through the tube of the other heat exchanger and out the latter as effluent. This flow is reversible by the use of proper valving, as is indicated in the solid and dotted lines of FIG. 3. Thus the reactor influent and conditioned liquid flow in the tubes only, either primary flow or reversed, where there is less chance of fouling and plugging from rags and other large pieces of waste.

The shells receive the third heat transfer medium as shown at 66 in broken lines. This medium flows through the shell of heat exchanger 60, and then through the shell of the other heat exchanger 62. These shells can be connected together and the third medium conducts the heat from the thermally conditioned effluent to the untreated influent. The flow of the third heat transfer medium need not be reversed as the process of FIG. 3. illustrates reactor influent-effluent interchange rather than reversal.

While the preferred embodiment illustrates the use of the principle for tube-in-tube heat exchangers, it will be obvious to one skilled in the art that the principle applies to all forms of countercurrent heat exchangers, e.g. if the hot and cold side flows are arranged in side-by-side relationship.

I claim:

1. The method of descaling a heat exchanger which includes a pair of noncommunicating passages in side-by-side heat exchange relation used for thermally conditioning a liquid and there being a reactor and a valved pipe circuitry with respect to said pair of noncommunicating passages, wherein the method comprises flowing during a first period influent liquid through one of said passages where the influent liquid is heated by a reactor thermally conditioning the influent liquid within the reactor whereby the liquid is further heated and exits from the reactor as a hot effluent liquid, passing the hot effluent liquid from the reactor through the other of said passages in counter-current heat exchange relationship with said influent liquid in said one of said passages, then during a second period flowing the influent liquid through said other of said passages in the same direction as previously traversed by said hot effluent liquid, while flowing the hot effluent liquid through said one of said passages in the same direction previously traversed by said influent liquid.

2. The method of descaling a heat exchanger during liquid treatment, wherein the heat exchanger includes a pair of non-communicating passages in side-by-side heat exchange relation in piped circuit with a reactor, said passages each having a pair of opposite ends, wherein the method comprises flowing during a first period influent liquid selectively to one end of one of said passages through said one passage, exiting the flow of influent liquid from the opposite end of said one of said passages into the reactor wherein the liquid undergoes thermal conditioning and exits from the reactor as a hot effluent liquid, flowing the effluent liquid through the other of said passages in countercurrent heat exchange relationship with said influent liquid in said one of said passages, and then during a second period reversing the flow of influent liquid through said one of said passages and reversing the flow of effluent liquid through the other of said passages.

3. The method of descaling heat exchangers for liquid treatment including a pair of heat exchangers and a reactor, in circuit, which comprises:

flowing forward reactor influent to one heat exchanger to and through the reactor and thence to and through the other heat exchanger; and interchanging the influent and effluent by passing the reactor influent through the second heat exchanger to and through the reactor and thence the effluent to and through the first named heat exchanger.

* * * * *